US008375534B2

(12) United States Patent
Gesell et al.

(10) Patent No.: US 8,375,534 B2
(45) Date of Patent: Feb. 19, 2013

(54) CREMATION CONTAINER

(75) Inventors: Justin Gesell, Brookville, IN (US); Nick Kaiser, Batesville, IN (US); Steve Pappas, Cincinnati, OH (US); Steven Pinkston, Columbus, IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 13/225,820

(22) Filed: Sep. 6, 2011

(65) Prior Publication Data

US 2012/0060334 A1 Mar. 15, 2012

Related U.S. Application Data

(60) Provisional application No. 61/382,713, filed on Sep. 14, 2010.

(51) Int. Cl.
*A61G 17/00* (2006.01)

(52) U.S. Cl. ..... 27/4; 229/198.1; 229/198.3; 217/12 R; 217/65; 220/7

(58) Field of Classification Search ..... 27/4, 2, 27/10, 1, 35; 229/199, 199.1, 198.1, 198.2, 229/198.3; 220/4.28, 4.33, 6, 7, 622, 651; 217/12 R, 13, 15, 65
See application file for complete search history.

(56) References Cited

U.S. PATENT DOCUMENTS

| | | | | |
|---|---|---|---|---|
| RE21,524 | E * | 8/1940 | Gramelspacher | 27/3 |
| 2,920,809 | A * | 1/1960 | Herschel | 206/521 |
| 5,709,016 | A | 1/1998 | Gulick et al. | |
| 6,202,270 | B1 | 3/2001 | Bowman et al. | |
| 6,557,221 | B2 | 5/2003 | Cox et al. | |
| 6,571,440 | B1 | 6/2003 | Faulkner et al. | |
| 7,249,403 | B2 * | 7/2007 | Davis et al. | 27/27 |
| 8,079,119 | B1 * | 12/2011 | Ferko, III | 27/4 |
| 8,104,151 | B2 * | 1/2012 | Cox et al. | 27/4 |
| 2009/0235491 | A1 * | 9/2009 | Cox | 16/439 |
| 2011/0314647 | A1 * | 12/2011 | Jackson | 27/2 |

* cited by examiner

*Primary Examiner* — William L. Miller
(74) *Attorney, Agent, or Firm* — Wood, Herron & Evans, LLP

(57) ABSTRACT

A cremation container foldable into a compact configuration for shipping comprises a bottom, a pair of side walls connected to the bottom, a pair of end walls connected to the bottom, and a lid removably positioned atop the pair of side walls and the pair of end walls. Each wall of the pair of side walls and each wall of the pair of end walls comprises an upper panel and a lower panel hingedly connected together. The upper panels of the pair of end walls are foldable downwardly toward the bottom, and the upper panels of the pair of side walls are foldable downwardly atop the upper panels of the pair of end walls to thereby compactly configure the container for shipping.

21 Claims, 4 Drawing Sheets

CREMATION CONTAINER

RELATED APPLICATIONS

This application claims the benefit of U.S. Provisional Patent Application Ser. No. 61/382,713 which is hereby incorporated by reference herein as if fully set forth in its entirety.

FIELD

The subject matter herein relates generally to caskets, and more particularly to that type of casket known as a cremation container.

BACKGROUND

Caskets have traditionally been employed for burial of the dead, both for in-ground burial and above-ground interment. Caskets are normally fabricated from fine furniture-grade wood or from highly polished/finished sheet metal for aesthetic reasons. So-called cremation containers, on the other hand, may be fabricated of cardboard, hardboard, oriented strand board ("OSB"), medium density fiberboard ("MDF"), plywood, etc., and as such are usually much less ornate than wood or metal caskets and therefore much less expensive. Cremation containers have been employed as containers for the deceased for which the family has chosen cremation as the means for ultimate disposition of the body. Both caskets and cremation containers traditionally include a lower shell or body portion and an upper cap or lid portion closeable on the lower portion. Due to their size and shape neither caskets nor cremation containers are cost-effectively shipped.

Efforts at increasing the cost-effectiveness of shipping caskets and cremation containers have been directed toward the design and development of so-called "knock-down" or "ready-to-assemble" caskets, that is to say, caskets which are shipped in a non-erected, compact package which are then erected at the shipping destination. A major goal of designers of such knock-down caskets has been to produce designs which are relatively quickly and simply erected with few or no tools being required. Success in this area has been more readily achieved in the case of cremation containers rather than in caskets, as cremation containers are by their very nature much less expensive than caskets and as such the fabrication techniques employed in knock-down designs detract from their appearance to a much lesser degree than do they from caskets.

One example of a knock-down casket is disclosed in the assignee's U.S. Pat. No. 5,709,016, hereby incorporated by reference herein as if fully set forth in its entirety. Examples of knock-down cremation containers are disclosed in the assignee's U.S. Pat. Nos. 6,202,270, 6,571,440, and 6,557,221, all hereby incorporated by reference herein as if fully set forth in their entirety. It is desirable to improve upon the casket and container designs of these patents.

SUMMARY

A cremation container foldable into a compact configuration for shipping comprises a bottom, a pair of side walls connected to the bottom, a pair of end walls connected to the bottom, and a lid removably positioned atop the pairs of side walls and end walls. Each wall of the pairs of side walls and end walls comprises an upper panel and a lower panel hingedly connected together. The upper panels of the pair of end walls are foldable downwardly toward the bottom, and the upper panels of the pair of side walls are foldable downwardly atop the upper panels of the pair of end walls to thereby compactly configure the container for shipping. Each upper panel of the pair of end walls includes a block attached at each end thereof with at least one hole therein. Each upper panel of the pair of side walls includes at least one through hole at each end thereof. The block hole aligns with the side wall upper panel through hole when the upper panels of the side and end walls are erected. A fastener is positioned in the aligned holes to secure the upper panels of the pairs of side walls and end walls in an erected state.

Each lower panel of the pairs of side walls and end walls can include a groove formed therein adjacent a lower edge thereof for receiving peripheral side and end edges of the bottom in the grooves. Each block can include a pair of holes therein and each upper panel of the pair of side walls can include a pair of holes therethrough. The two block holes align with the two side wall upper panel through holes when the side and ends walls are erected. A fastener can be positioned in each pair of aligned holes. The fasteners can be wooden dowel pins. The container can further include at least one handle mounted to each lower panel of the pairs of side walls and end walls. The lower panels can include a pair of through holes for each handle, and the handle can comprise a length of rope passing through the pair of holes, the rope being knotted on opposite ends thereof interior of the container. The lid can include a cleat adjacent each corner thereof which cooperates with a respective corner formed by adjacent ones of the upper panels of the side and end walls to prevent the lid from sliding off of upper edges of the pairs of side walls and end walls. The container can further include a spacer positioned between and abutting the blocks of each upper panel of the pair of end walls. The blocks and spacers can be secured to the upper panels with adhesive. The blocks and spacers can be fabricated of wood. The edges of the bottom can be retained in the grooves in the lower panels of the side and end walls with adhesive and/or staples. The upper panels can be hingedly connected to the lower panels with cardboard living hinges. The side walls can be fabricated of ¾ inch thick birch plywood. The end walls can also be fabricated of ¾ inch thick birch plywood. The lid can be fabricated of ¾ inch thick medium density fiberboard. The bottom can be fabricated of ½ inch thick oriented strand board. Alternatively, the lower panels of the side walls and end walls can be fabricated of pine, and the upper panels of the side walls and end walls can be fabricated of chipboard or particle board. Further, the side walls, end walls, and lid can have an attractive poplar veneer applied to exterior surfaces thereof as by adhesive for aesthetics.

The side walls and end walls can be about 12.375 inches tall. The lower panels of the end walls can be about 3.183 inches tall and the lower panels of the side walls can be about 4.5 inches tall. The exterior surfaces of the side walls, end walls, and lid can have a poplar veneer applied thereto.

DRAWINGS

DESCRIPTION

Figure 1:
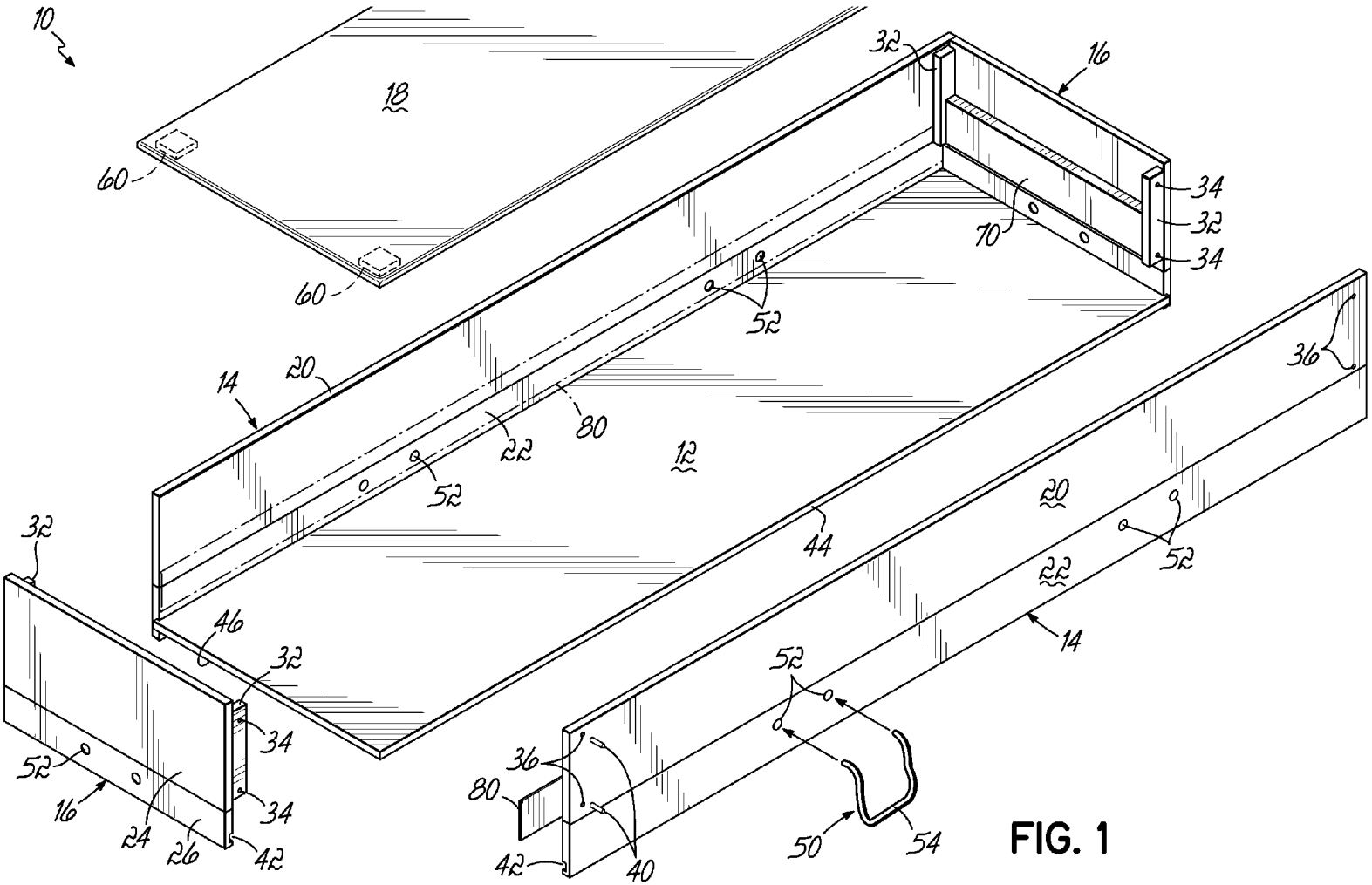
FIG. 1 is a disassembled perspective view of the cremation container.
Figure 1A:
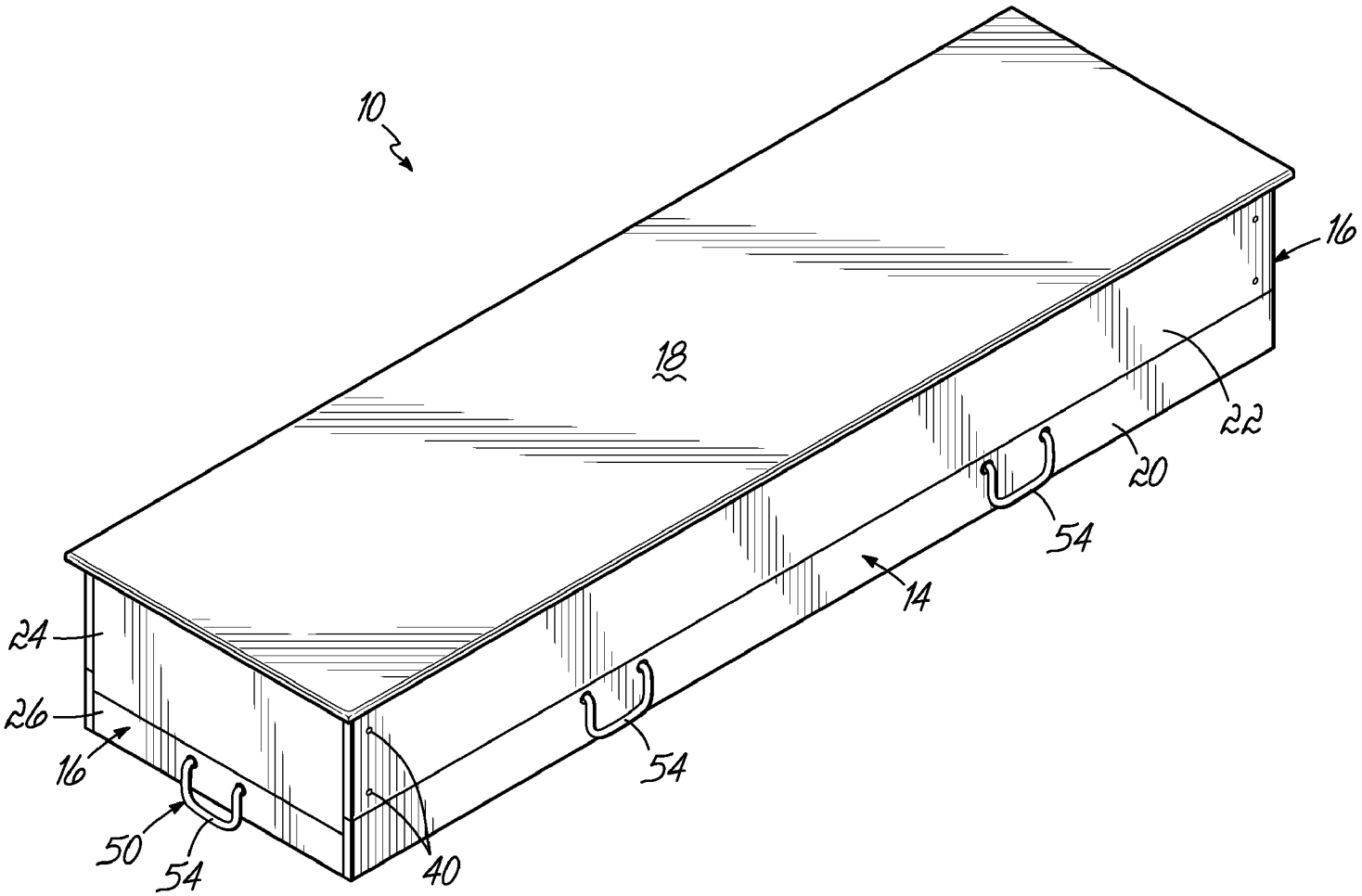
FIG. 1A is an assembled perspective view of the cremation container of FIG. 1.

Referring first to the FIGS. 1 and 1A, a cremation container 10 foldable into a compact configuration for shipping is illustrated. The container 10 comprises a bottom 12, a pair of side walls 14, 14 connected to the bottom 12, a pair of end walls 16, 16 connected to the bottom 12, and a lid 18 removably positioned atop the pairs of side walls 14, 14 and end walls 16, 16. Each wall 14 of the pair of side walls 14, 14 comprises an upper panel 20 and a lower panel 22 hingedly connected together. Similarly, each wall 16 of the pair of end walls 16, 16 comprises an upper panel 24 and a lower panel 26 hingedly connected together.

Figure 3A:
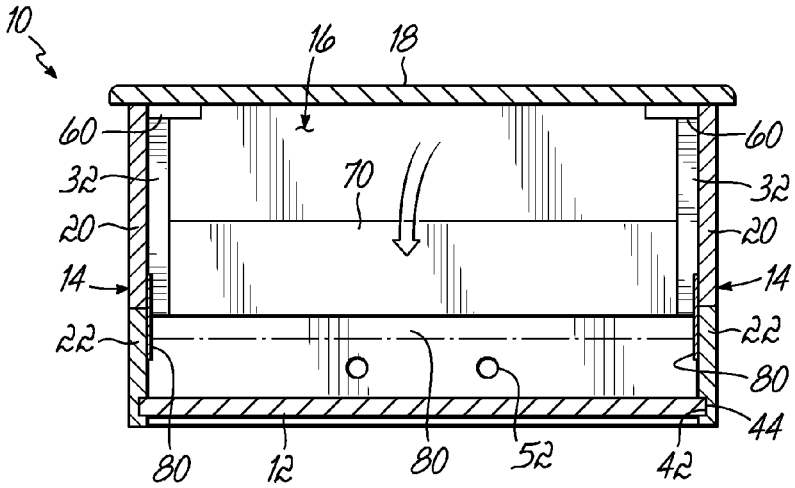
FIGS. 3A-3C are cross-sectional views taken along line 3-3 in FIG. 2.
Figure 3B:
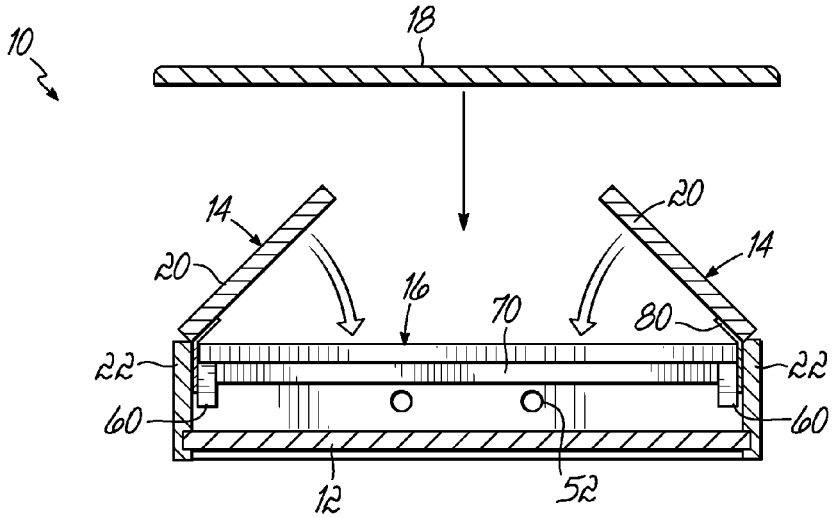
Figure 3C:
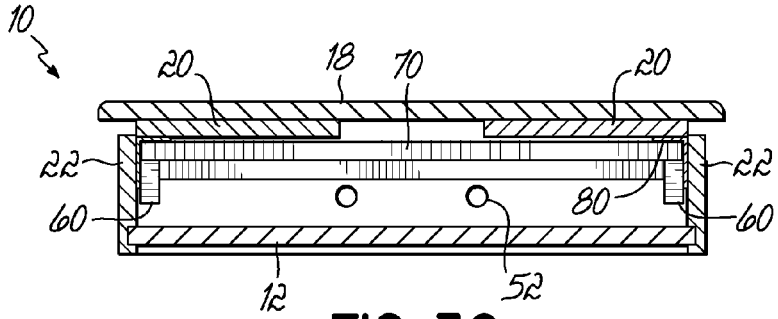

Referring to FIGS. 3A-3C, the upper panels 24 of the pair of end walls 16, 16 are foldable downwardly toward the bottom 12, and the upper panels 20 of the pair of side walls 14, 14 are foldable downwardly atop the upper panels 24 of the pair of end walls 16, 16 to thereby compactly configure the container for shipping. The lid 18 can be placed atop the folded end walls 16, 16 and folded side walls 14, 14, and the thusly knocked down cremation container 10 can be slid into a shipping carton (not shown) for shipping.

Figure 2:
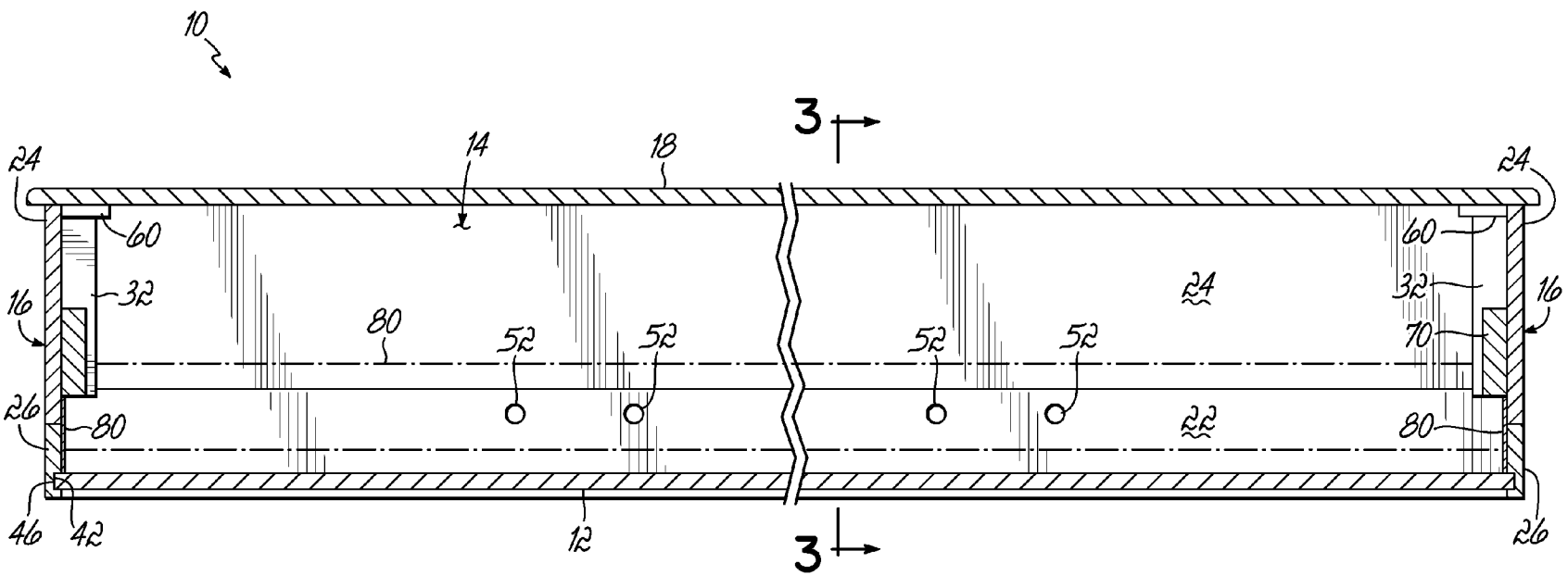
FIG. 2 is a cross-sectional view taken along the longitudinal axis of the assembled cremation container of FIG. 1A.

Referring to FIGS. 1 and 2, each upper panel 24 of the pair of end walls 16, 16 can include a block 32 attached at each end thereof. The block 32 has at least one hole 34 therein. Each upper panel 20 of the pair of side walls 14, 14 includes at least one through hole 36 at each end thereof. The block hole 34 aligns with the side wall 14 upper panel 20 through hole 36 when the upper panels 20, 24, of the side walls 14, 14 and end walls 16, 16, respectively, are erected. A fastener, for example a wooden dowel pin 40, is positioned in the aligned holes 34, 36 to secure the upper panels 20 of the pair of side walls 16, 16 and the upper panels 24 of the pair of end walls 16, 16 in an erected state.

Referring to FIGS. 1, 2, and 3A-3C, each lower panel 22, 26 of the pairs of side walls 14, 14 and end walls 16, 16, respectively, can include a dado groove 42 formed therein adjacent a lower edge thereof. The bottom 12 has peripheral side 44, 44 and end 46, 46 edges which can be retained in the grooves 42.

In a preferred form each block 32 includes a pair of holes 34, 34 therein, each upper panel 20 of the pair of side walls 16, 16 includes a pair of holes 36, 36 therethrough, and a pair of fasteners, for example wooden dowel pins 40, 40 are positioned in the aligned holes 34, 36.

Referring to FIGS. 1 and 1A, the container 10 can further including at least one handle 50 mounted to each lower panel 22, 26 of the pairs of side walls 14, 14 and end walls 16, 16, respectively. The lower panels 22, 26 can include a pair of through holes 52, 52 for each handle 50. The handle 50 can comprise a length of rope 54 passing through the pair of holes 52, 52, the rope 54 being knotted on opposite ends thereof interior of the container 10.

Referring to FIG. 1, the container lid 18 can include a cleat 60 adjacent each corner thereof which cooperates with a respective corner formed by adjacent ones of the upper panels 20, 24 of the side 14, 14 and end 16, 16 walls to prevent the lid 18 from sliding off of upper edges of the pairs of side walls 14, 14 and end walls 16, 16. Lid 18 can be a full length lid, or a split lid, for example 60/40 or other desired ratio.

Referring to FIGS. 1 and 3A-3C, the upper panel 24 of each of the pair of end walls 16, 16 can further include a spacer 70 positioned between and abutting the blocks 32 to prevent the blocks 32 from becoming dislodged when dowel pins 40 are driven into holes 34, 36 (which may require a lightweight mallet or the like). The blocks 32 and spacers 70 can be fabricated of wood and can be secured to the upper panels 24 with adhesive, while the edges 44, 46 of the bottom 12 can be retained in dado groove 42 with adhesive or staples or adhesive and staples. The upper panels 20, 24 are hingedly connected to the lower panels 22, 26, respectively, with cardboard living hinges 80.

With respect to materials, the side walls 14, 14 can be fabricated of ¾ inch thick birch plywood, the end walls 16, 16 can be fabricated of ¾ inch thick birch plywood, the lid 18 can be fabricated of ¾ inch thick medium density fiberboard, and the bottom 12 can be fabricated of ½ inch thick oriented strand board. The spacers 70 can be 1"×4" lumber (i.e. "one by four"). The corner blocks 32 can be 1.5 inch by 1.5 inch wooden blocks. Other materials can be used. For example, the lower panels of the side walls and end walls can be fabricated of pine, and the upper panels of the side walls and end walls can be fabricated of chipboard or particle board. Further, the side walls, end walls, and lid can have an attractive poplar veneer applied thereto as by adhesive for aesthetics.

The side walls 14, 14 and end walls 16, 16 can be about 12.375 inches tall. The lower panels 26 of the end walls 16, 16 can be about 3.183 inches tall and the lower panels 22 of the side walls 12, 12 can be about 4.5 inches tall. This enables the container 10, when knocked down for shipping, to be about 50% of its erected height. The overall length and width of the container 10 is about 79.25 inches long by about 22.75 inches wide.

The embodiments shown and described are merely for illustrative purposes only. The drawings and the description are not intended to limit in any way the scope of the claims. Those skilled in the art will appreciate various changes, modifications, and other embodiments. All such changes, modifications and embodiments are deemed to be embraced by the claims. Accordingly, the scope of the right to exclude shall be limited only by the following claims and their equivalents.

What is claimed is:

1. A cremation container foldable into a compact configuration for shipping comprising:

a bottom, a pair of side walls connected to said bottom, a pair of end walls connected to said bottom, and a lid removably positioned atop said pair of side walls and said pair of end walls, each wall of said pair of side walls and each wall of said pair of end walls comprising an upper panel and a lower panel hingedly connected together, said upper panels of said pair of end walls being foldable downwardly toward said bottom, said upper panels of said pair of side walls being foldable downwardly atop said upper panels of said pair of end walls to thereby compactly configure said cremation container for shipping, each said upper panel of said pair of end walls including a block attached at each end thereof to an interior side thereof, said block having at least one hole therein, each said upper panel of said pair of side walls including at least one through hole at each end thereof, said block hole aligned with said side wall upper panel through hole when said upper panels of said side and end walls are in an erected state, and a respective fastener positioned in said aligned holes to secure said upper panels of said pair of side walls and said pair of end walls in said erected state, whereby said cremation container is adapted to receive a deceased.

2. The cremation container of claim 1 wherein each said lower panel of said pair of side walls and said pair of end walls includes a groove formed therein adjacent a lower edge thereof, and said bottom has peripheral side and end edges retained in said grooves.

3. The cremation container of claim 2 wherein said edges of said bottom are retained in said grooves in said lower panels of said side and end walls with adhesive and/or staples.

4. The cremation container of claim 1 wherein each said block includes a pair of said holes therein and each said upper panel of said pair of side walls includes a pair of said through holes, said two block holes aligned with said two upper panel through holes when said side and ends walls are in the erected state, and said respective fastener positioned in each pair of aligned holes.

5. The cremation container of claim 4 wherein said fasteners are wooden dowel pins.

6. The cremation container of claim 1 further including at least one handle mounted to each said lower panel of said pair of side walls and said pair of end walls.

7. The cremation container of claim 6 wherein said lower panels include a pair of through holes for each said handle, and said handle comprises a length of rope passing through said pair of holes, said rope being knotted on opposite ends thereof interior of said cremation container.

8. The cremation container of claim 1 wherein said lid includes a cleat adjacent each corner thereof which cooperates with a respective corner formed by adjacent ones of said upper panels of said side and end walls to prevent said lid from sliding off of upper edges of said pair of side walls and said pair of end walls.

9. The cremation container of claim 1 further including a spacer positioned between and abutting said blocks of each said upper panel of said pair of end walls.

10. The cremation container of claim 9 wherein said blocks and spacers are secured to said upper panels of said pair of end walls with adhesive.

11. The cremation container of claim 10 wherein said blocks and spacers are fabricated of wood.

12. The cremation container of claim 1 wherein said upper panels are hingedly connected to said lower panels with cardboard living hinges.

13. The container of claim 1 wherein side walls are fabricated of ¾ inch thick birch plywood.

14. The cremation container of claim 1 wherein said end walls are fabricated of ¾ inch thick birch plywood.

15. The cremation container of claim 1 wherein said lid is fabricated of ¾ inch thick medium density fiberboard.

16. The cremation container of claim 1 wherein said bottom is fabricated of ½ inch thick oriented strand board.

17. The cremation container of claim 1 wherein said side walls and end walls are about 12.375 inches tall.

18. The cremation container of claim 1 wherein said lower panels of said end walls are about 3.183 inches tall and said lower panels of said side walls are about 4.5 inches tall.

19. The cremation container of claim 1 wherein exterior surfaces of said side walls, end walls, and lid have a poplar veneer applied thereto.

20. The cremation container of claim 1 wherein said lower panels of said pairs of side walls and end walls are fabricated of pine, and said upper panels of said pairs of side walls and ends walls are fabricated of chipboard or particle board.

21. A cremation container foldable into a compact configuration for shipping comprising:

a bottom, a pair of side walls connected to said bottom, a pair of end walls connected to said bottom, and a lid removably positioned atop said pair of side walls and said pair of end walls, each wall of said pair of side walls and each wall of said pair of end walls comprising an upper panel and a lower panel hingedly connected together, said upper panels of said pair of end walls being foldable downwardly toward said bottom, said upper panels of said pair of side walls being foldable downwardly atop said upper panels of said pair of end walls to thereby compactly configure said cremation container for shipping, each said upper panel of said pair of end walls including a block attached at each end thereof to an interior side thereof, each said block aligned with a respective end of said side wall upper panels when said upper panels of said side and end walls are in an erected state, and at least one fastener passing through each said upper panel of said pair of side walls at each end thereof and into a respective one of said blocks of said upper panel of a respective one of said end walls to secure said upper panels of said side and end walls in said erected state, whereby said cremation container is adapted to receive a deceased.

* * * * *